United States Patent [19]

Hirota

[11] 3,991,879

[45] Nov. 16, 1976

[54] CRATE FOR CARRYING BOTTLES, CANS OR THE LIKE ARTICLES

[75] Inventor: Kashichi Hirota, Hachioji, Japan

[73] Assignee: Kyowa Electric & Chemical Co., Ltd., Hachioji, Japan

[22] Filed: Oct. 14, 1975

[21] Appl. No.: 621,741

[30] Foreign Application Priority Data

Oct. 22, 1974 Japan ..... 49-121813

[52] U.S. Cl. ..... 206/203; 206/510

[51] Int. Cl.[2] ..... B65D 81/26

[58] Field of Search ..... 224/45 AB, 45 A, 48 F; 206/144, 141, 139, 503, 505, 506, 509, 203, 510, 515, 518, 519, 520

[56] References Cited

UNITED STATES PATENTS

| | | | |
|---|---|---|---|
| 3,184,148 | 5/1965 | Poupitch | 206/203 |
| 3,283,947 | 11/1966 | Cornelius | 206/203 |

*Primary Examiner*—L. J. Paperner
*Assistant Examiner*—Kenneth Noland
*Attorney, Agent, or Firm*—Newton, Hopkins & Ormsby

[57] ABSTRACT

Bottle carrying crate which has six bottle receiving compartments arranged in two rows. The crate is also provided with an over-top handle for facilitating single hand carrying of the crate. The design of the crate is such that a plurality of crates can be stacked one on the other with minimum vertical dimension.

6 Claims, 4 Drawing Figures

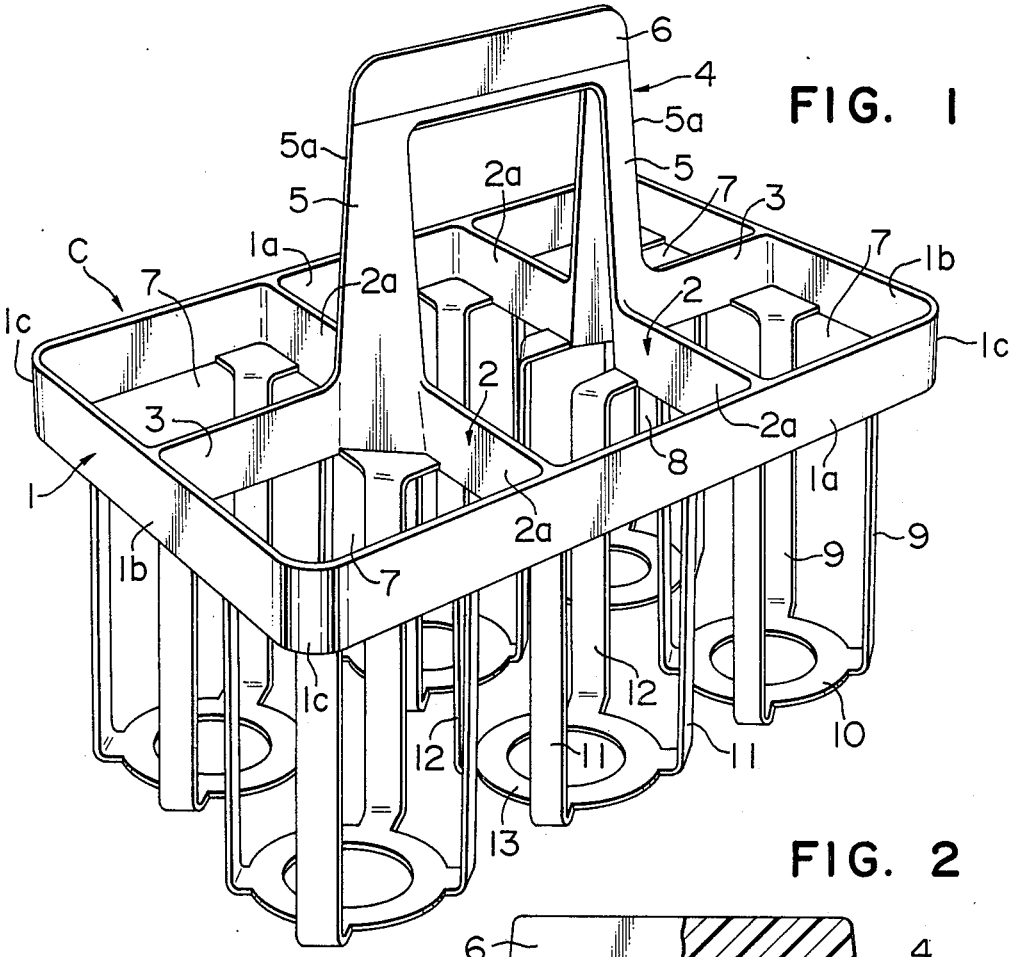
FIG. 1
FIG. 2
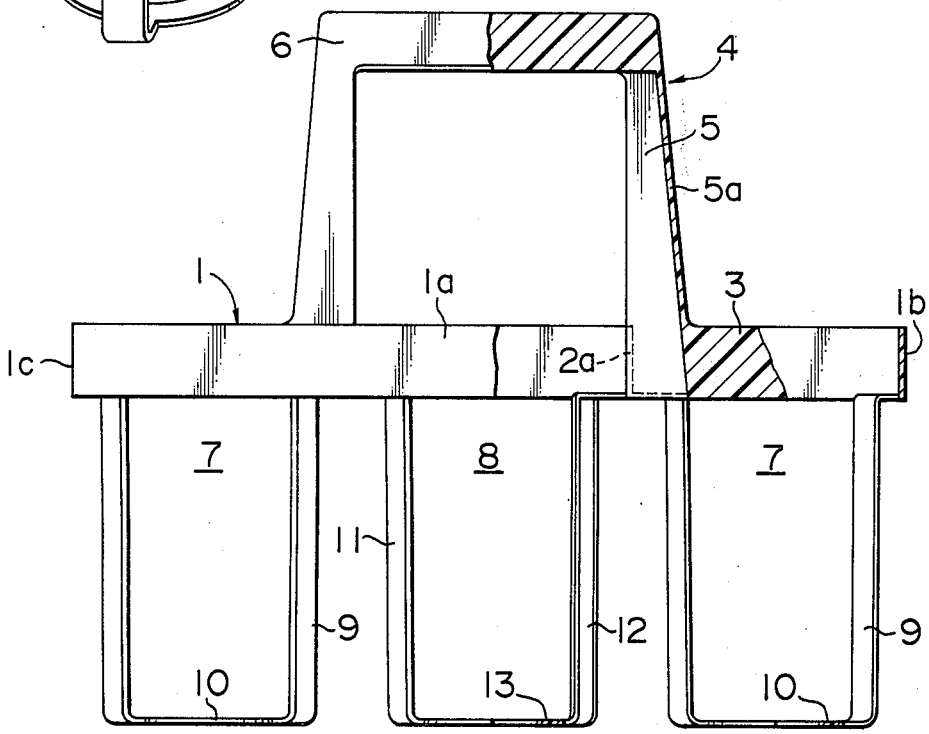

CRATE FOR CARRYING BOTTLES, CANS OR THE LIKE ARTICLES

The present invention relates to a crate for carrying bottles, cans or the like and, more particularly to a crate which can be readily stacked together with the same type of crates.

Crates for carrying bottles, cans or the like articles can conveniently be manufactured through plastic moulding technique. It is further a common practice in small size crates to provide an over-top handle so that the crates can be conveniently carried by a single hand. In conventional crate designs having such an over-top handle, however, inconveniencies have been encountered in that, when empty crates are stacked one on the other for the purpose of stocking and transportation, the stack occupies a substantial vertical space due to the existence of the handles.

Therefore, it is an object of the present invention to provide moulded plastic crates which are provided with over-top handles and can be readily stacked one on the other when they are empty.

Another object of the present invention is to provide crates having separated compartments for receiving bottles, cans and the like articles, so as to prevent the articles being carried are prevented from beating against the other.

According to the present invention, the above and other objects can be accomplished by a crate comprising a substantially triangular top frame having a pair of opposed side walls and a pair of opposed end walls, a pair of parallely spaced transverse top partitions extending between the opposed side walls of the top frame, a longitudinal top partition extending between one of the transverse top partitions and the adjacent one of the end walls of the top frame, a second longitudinal top partition extending between the other of the transverse top partititons and the other of the end walls of the top frame, each intersection between the associated transverse and longitudinal top partitions being in the form of a V-shaped cross-section which opens toward the other transverse top partition, a handle including a pair of substantially upright portions each extending upwardly from each of said intersections between the associated transverse and longitudinal top partitions, and a horizontal portion extending between the pair of upright portions, each of said upright portions including a pair of side walls connected along a ridge to form a V-shaped cross-section which is continuous with and merges into the V-shaped configuration at the associated intersection between the transverse and the longitudinal top partitions, the depth of the V-shape in each upright portion of the handle being gradually decreased upwardly with the ridge inclined inwardly, end compartment defining side wall means extending downwardly from an opening defined by each interconnected side and end walls of the top frame and the transverse and longitudinal top partitions, said wall means being slightly converged toward lower end where it is connected with a bottom wall, two separated intermediate compartment defining side wall means each extending downwardly from the portion of each side wall of the top frame which is located between the pair of transverse partitions, and the portions of the transverse partitions which are located between the handle upright portions and the side wall of the top frame, each of said intermediate compartment defining side wall means being slightly converged toward lower end where it is connected with a bottom wall. In a preferable aspect of the present invention, said end compartment defining side wall means comprises four substantially vertically extending elongated strap-like wall elements connected at upper ends with corner portions of tetragon formed by the top frame and the longitudinal and transverse partitions. Similarly, the intermediate compartment defining side wall means comprises four substantially vertically extending elongated strap-like wall elements, two being connected at upper ends respectively with corner portions at the intersections between the top frame and the transverse partitions, and the remaining two being connected at upper ends respectively with the transverse partitions at the ends thereof adjacent to the handle upright portions.

The above and other objects and features of the present invention will become apparent from the following descriptions of a preferred embodiment taking reference to the accompanying drawings, in which:

FIG. 1 is a perspective view of a crate in accordance with one embodiment of the present invention;

FIG. 2 is a side view of the crate shown in FIG. 1 with parts removed in order to show the details of the structure;

Figure 3:
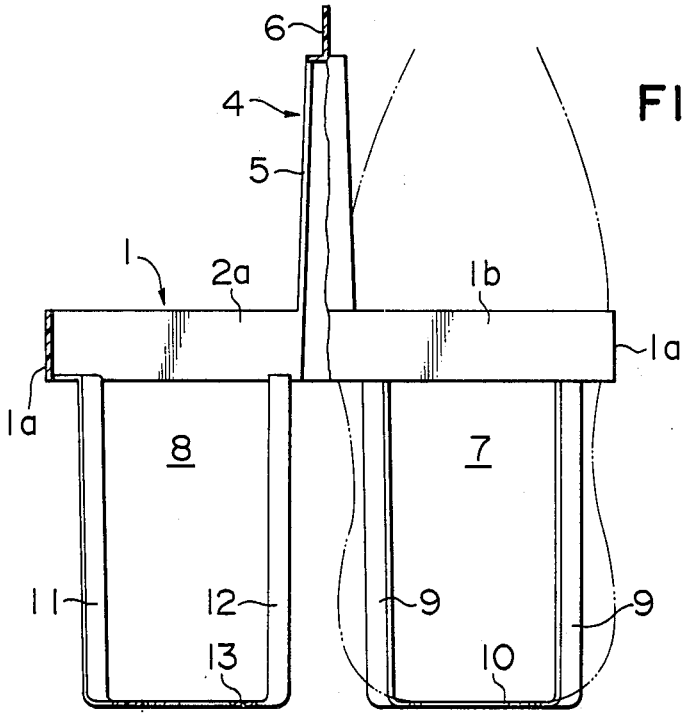
FIG. 3 is a partially sectioned end view of the crate shown in FIGS. 1 and 2.

Referring now to the drawings, particularly to FIGS. 1 through 3, the crate C shown therein comprises a substantially rectangular top frame 1 which includes a pair of a side walls 1*a* and a pair of end walls 1*b* which are connected together at corner portions 1*c* thereof. In the illustrated embodiment, the end wall 1*b* is two-third in length of the side wall 1*a*. A pair of spaced parallel transverse partitions 2 are formed integrally with the side walls 1*a* at such positions that each side wall 1*a* is divided into three portions of equal lengths. Between each transverse partition 2 and the adjacent end wall 1*b*, there is formed a longitudinal partition 3 extending along the longitudinal center line of the rectangle defined by the top frame 1. As seen in FIG. 1, the intersection between each of the transverse partition 2 and the associated longitudinal partition 3 is of a V-shaped cross-section so that each transverse partition 2 is divided into two portions of equal length.

A handle 4 is integrally formed with the transverse and the longitudinal partitions 2 and 3. The handle 4 comprises a pair of upright portions 5 and a top portion 6 connecting the upright portions together at the upper ends thereof. Each of the upright portions 5 is of V-shaped cross-section which is continuous with and merges into the V-shape defined at the intersection of the transverse and the longitudinal partitions 2 and 3. As shown in FIG. 3, the top portion 6 is of an inverted T-shaped so that an increased rigidity can be obtained. As shown in FIGS. 1 and 2, the upright portion 5 is so formed that the ridge portion 5*a* is inclined upwardly and inwardly. Thus, four square-shaped end openings 7 are defined by the top frame 1 and the transverse and the longitudinal partitions 2 and 3 at the longitudinally opposite ends of the top frame 1. Further, a rectangular intermediate opening 8 is defined between the opposed transverse partitions 2.

In each of the end opening 7, four compartment defining side wall elements 9 are integrally formed with the top frame 1 and the transverse and longitudinal partitions 2 and 3 and extending downwardly from corner portions of the end opening 7. The elements 9 are so formed that they define a cylindrical compartment which slightly converges toward lower end thereof. At the lower end, an annular bottom plate 10 is integrally formed with the elements 9. Similar arrangements are also made with respect to the other square opening 7 so that the same compartment is defined beneath each opening 7.

In the opening 8, two intermediate compartment defining side wall elements 11 are integrally formed with the top frame 1 and the transverse partitions 2 so as to extend downwardly from the intersections between each side wall 1*a* and the transverse partitions 2. Further, the portions 2*a* of the transverse partitions 2 are provided at the ends adjacent to the upright portions 5 of the handle 4 with two intermediate compartment defining side wall elements 12, one on each of the transverse partition portion 2*a*. As in the case of the elements 9, the elements 11 and 12 are so formed that they define a cylindrical intermediate compartment which slightly converges toward lower ends thereof. An annular bottom plate 13 is integrally formed with the lower ends of the elements 11 and 12. Similar arrangement is also made with respect to the other side of the opening 8 so that two identical intermediate compartments are defined beneath the opening 8.

Figure 4:
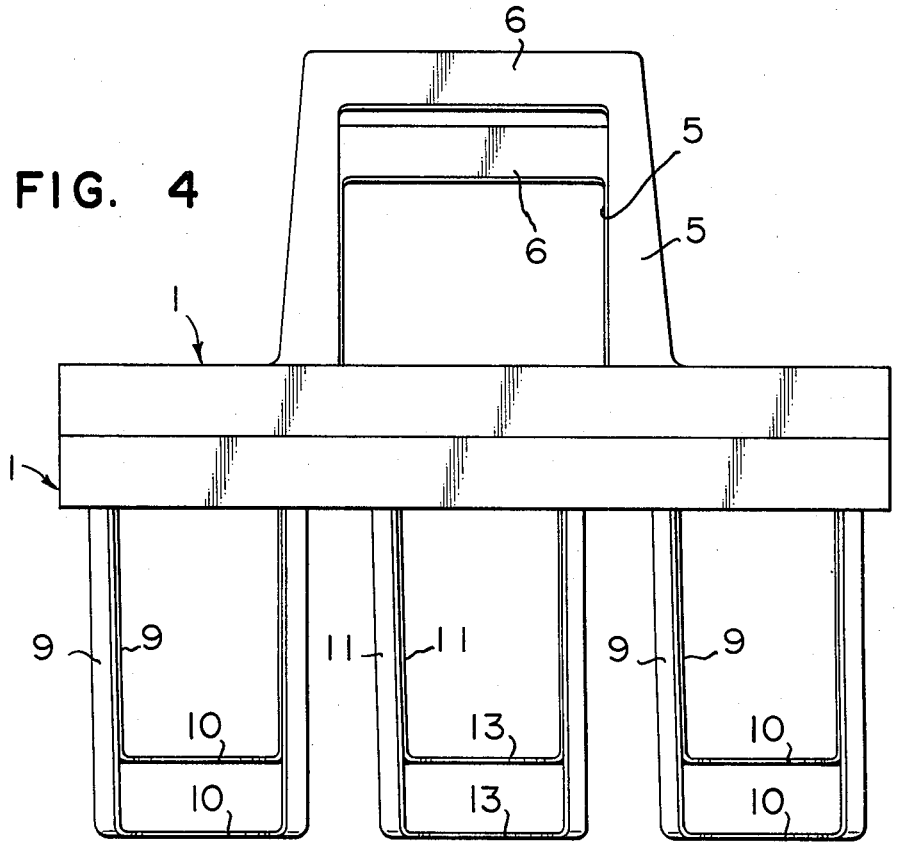
FIG. 4 is a side view showing two stacked crates.

In the aforementioned crate design, it will be apparent that each of the article receiving compartments are defined by completely separated side wall elements and have downwardly converging configuration. Further, the handle 4 is of upwardly converging external and internal configurations. Therefore, a plurality of such crates C can be stacked together as shown in FIG. 4 with the top frames 1 thereof engaging each other. Thus, the stack of crates C occupies minimum vertical space. The crates can be conveniently manufactured through conventional plastic moulding technique. Further, the compartments can receive bottles, cans or the like articles and protect them from external shock loads.

The invention has thus been shown and described with reference to a preferable embodiment, however, it should be noted that the invention is in no way limited to the details of the illustrated configurations but changes and modifications may be made without departing from the scope of the appended claims.

I claim:

1. Crate for carrying bottles, cans and the like articles, said crate comprising a substantially rectangular top frame having a pair of opposed side walls and a pair of opposed end walls, a pair of parallely spaced transverse top partitions extending between the opposed side walls of the top frame, a longitudinal top partition extending between one of the transverse top partitions and the adjacent one of the end walls of the top frame, a second longitudinal top partition extending between the other of the transverse top partitions and the other of the end walls of the top frame, each intersection between the associated transverse and longitudinal top partitions being in the form of a V-shaped cross-section which opens toward the other transverse top partition, a handle including a pair of substantially upright portions each extending upwardly from each of said intersections between the associated transverse and longitudinal top partitions, and a horizontal portion extending between the pair of upright portions, each of said upright portions including a pair of side walls connected along a ridge to form a V-shaped cross-section which is continuous with and merges into the V-shaped configuration at the associated intersection between the transverse and the longitudinal top partitions, the depth of the V-shape in each upright portion of the handle being gradually decreased upwardly with the ridge inclined inwardly, end compartment defining side wall means extending downwardly from an opening defined by each interconnected side and end walls of the top frame and the transverse and longitudinal top partitions, said wall means being slightly converged toward lower end where it is connected with a bottom wall, two separated intermediate compartment defining side wall means each extending downwardly from the portion of each side wall of the top frame which is located between the pair of transverse partitions, and the portions of the transverse partitions which are located between the handle upright portions and the side wall of the top frame, each of said intermediate compartment defining side wall means being slightly converged toward lower end where it is connected with a bottom wall.

2. Crate in accordance with claim 1 in which each of said end and intermediate compartment defining side wall means comprises a plurality of substantially vertically extending strap-like elements.

3. Crate in accordance with claim 2 in which said strap like elements for each end compartment are so formed that they extend downwardly from corner portions of a rectangle defined by the side and end walls of the top frame and the associated transverse and longitudinal partitions.

4. Crate in accordance with claim 2 in which said strap elements for each intermediate compartment are so formed that they extend downwardly from the intersections between the transverse partitions and the associated side wall of the top frame and also between the transverse partitions and the upright portions of the handle.

5. Crate in accordance with claim 2 in which said bottom wall for each compartment is in the form of an annular plate.

6. Crate in accordance with claim 1 in which said end wall of the top frame is two-third in length of the side wall thereof, the transverse partitions being located in such positions that they divide each side wall of the top frame into three portions of equal length, and said longitudinal portions being located along longitudinal center of the top frame.

* * * * *